US012167762B2

(12) United States Patent
Yasutomo et al.

(10) Patent No.: US 12,167,762 B2
(45) Date of Patent: Dec. 17, 2024

(54) CORE-SHEATH COMPOSITE FIBER FOR ARTIFICIAL HAIR, HEADDRESS PRODUCT INCLUDING SAME, AND PRODUCTION METHOD THEREFOR

(71) Applicant: KANEKA CORPORATION, Osaka (JP)

(72) Inventors: Norikazu Yasutomo, Osaka (JP); Genta Sakamoto, Osaka (JP); Hiroshi Fujinaga, Osaka (JP)

(73) Assignee: KANEKA CORPORATION, Osaka (JP)

( * ) Notice: Subject to any disclaimer, the term of this patent is extended or adjusted under 35 U.S.C. 154(b) by 600 days.

(21) Appl. No.: 17/393,818

(22) Filed: Aug. 4, 2021

(65) Prior Publication Data

US 2021/0361011 A1 Nov. 25, 2021

Related U.S. Application Data

(63) Continuation of application No. PCT/JP2020/001144, filed on Jan. 16, 2020.

(30) Foreign Application Priority Data

Feb. 15, 2019 (JP) ..... 2019-025699

(51) Int. Cl.
*A41G 3/00* (2006.01)
*A41G 5/00* (2006.01)
(Continued)

(52) U.S. Cl.
CPC ..... *A41G 3/0083* (2013.01); *A41G 5/004* (2013.01); *D01F 8/12* (2013.01); *D01F 8/14* (2013.01); *D10B 2503/08* (2013.01)

(58) Field of Classification Search
CPC ..... A41G 3/0083; A41G 5/004; D01F 8/12; D01F 8/14; D01F 8/06; D01F 6/78;
(Continued)

(56) References Cited

U.S. PATENT DOCUMENTS

2016/0088888 A1* 3/2016 Yorizane ..... A63H 3/44 446/268
2019/0090565 A1 3/2019 Miyata et al.
2020/0024774 A1 1/2020 Yasutomo et al.

FOREIGN PATENT DOCUMENTS

EP 3603432 A1 2/2020
WO 2007/086374 A1 8/2007
(Continued)

OTHER PUBLICATIONS

International Search Report issued in corresponding International Patent Application No. PCT/JP2020/001144 dated Mar. 10, 2020 (5 pages).
(Continued)

*Primary Examiner* — Camie S Thompson
(74) *Attorney, Agent, or Firm* — Osha Bergman Watanabe & Burton LLP

(57) ABSTRACT

The present disclosure relates to a core-sheath conjugate fiber for artificial hair including a core part and a sheath part. The core-sheath conjugate fiber for artificial hair has a flat multilobed cross sectional shape, and has a core-to-sheath area ratio of 2:8 to 9:1, and a viscosity ratio a/b between a melt viscosity a of a core part resin composition and a melt viscosity b of a sheath part resin composition is 2.0 or more and 7.0 or less. The present disclosure provides a core-sheath conjugate fiber for artificial hair having a touch close to that of human hair, excellent peel resistance at room temperature, and good combing property, a hair ornament product including the core sheath conjugate fiber, and a production method.

6 Claims, 2 Drawing Sheets

(51) Int. Cl.
*D01F 8/12* (2006.01)
*D01F 8/14* (2006.01)

(58) Field of Classification Search
CPC ..... D10B 2503/08; D10B 2501/00; D10B 2331/04; D01D 5/22; D01D 5/24; D01D 5/253; A63H 3/44428; A63H 3/44
USPC ..... 428/373
See application file for complete search history.

(56) References Cited

FOREIGN PATENT DOCUMENTS

| | | | |
|---|---|---|---|
| WO | 2017/187843 | A1 | 11/2017 |
| WO | 2018/179803 | A1 | 10/2018 |

OTHER PUBLICATIONS

Written Opinion issued in corresponding International Patent Application No. PCT/JP2020/001144 dated Mar. 10, 2020 (3 pages).
Decision of Refusal issued in Japanese Application No. 2020-572131 mailed Feb. 15, 2024 (6 pages).

* cited by examiner

CORE-SHEATH COMPOSITE FIBER FOR ARTIFICIAL HAIR, HEADDRESS PRODUCT INCLUDING SAME, AND PRODUCTION METHOD THEREFOR

TECHNICAL FIELD

One or more embodiments of the present invention relate to a core-sheath conjugate fiber for artificial hair capable of being used as an alternative to human hair, a hair ornament product including the same, and a production method therefor.

BACKGROUND

Conventionally, human hair is used for hair ornament products such as hairpieces, hair wigs, hair extensions, hair bands, and doll hair. However, in recent years, it is becoming difficult to obtain human hair, and thus there is an increasing demand for fibers for artificial hair capable of being used as an alternative to human hair. Artificial hair is required to have a touch and appearance close to those of human hair, and examples of synthetic fibers that can be used for artificial hair include acrylic-based fibers, vinyl chloride-based fibers, vinylidene chloride-based fibers, polyester-based fibers, polyamide-based fibers, and polyolefin-based fibers. In particular, a core-sheath conjugate fiber containing polyester as a core component and polyamide as a sheath component has been developed as a fiber for artificial hair having a texture close to that of human hair, and excellent durability and heat resistance (Patent Document 1). If this core-sheath conjugate fiber has a viscosity ratio a/b between a melt viscosity a of polyester and a melt viscosity b of polyamide at 285° C. of 0.5 to 2.5, a fiber for artificial hair having excellent durability and heat resistance is obtained.

PATENT DOCUMENT

Patent Document 1: WO 2017/187843

However, although a peel strength (alternatively referred to as "peel resistance") between the core and the sheath under a heated condition during heating at 220° C. of the fiber described in Patent Document 1 was evaluated as an indicator of durability, there is no description on the peel resistance at room temperature (20±5° C.) in spite of the peel resistance at a temperature when the fiber is actually worn by a user, that is, at room temperature being important. Furthermore, the temperature 285° C. at which the melt viscosity is determined is groundless and has no correlation with 220° C. at which the peel resistance is checked, and, even when the melt viscosity ratio between the core and sheath components at 285° C. is lowered, peeling occurs at an interface between the core and the sheath of the fiber for artificial hair at room temperature. Thus, the peel resistance remains low and as a result, the touch and the combing property of this fiber are poor, and there is room for improvement also from the viewpoint of yield in fiber production.

In order to address the above, one or more embodiments of the present invention provide a core-sheath conjugate fiber for artificial hair having a touch close to that of human hair, excellent peel resistance at room temperature, and good combing property, and a hair ornament product.

SUMMARY

In one or more embodiments, the present invention relates to a core-sheath conjugate fiber for artificial hair including a core part and a sheath part, wherein the core-sheath conjugate fiber for artificial hair has a flat multilobed cross sectional shape, and has a core-to-sheath area ratio on a fiber cross section of core:sheath=2:8 to 9:1, and a viscosity ratio a/b between a melt viscosity a of a core part resin composition and a melt viscosity b of a sheath part resin composition is 2.0 or more and 7.0 or less.

Furthermore, in one or more embodiments, the present invention relates to a hair ornament product including the core-sheath conjugate fiber for artificial hair.

Furthermore, in one or more embodiments, the present invention relates to a production method for the core-sheath conjugate fiber for artificial hair, including a step of melt spinning a core part resin composition and a sheath part resin composition, using a core-sheath conjugate nozzle, wherein a viscosity ratio a/b between a melt viscosity a of a core part resin composition and a melt viscosity b of a sheath part resin composition at a set temperature of the core-sheath conjugate nozzle is 2.0 or more and 7.0 or less.

According to one or more embodiments of the present invention, it is possible to provide a core-sheath conjugate fiber for artificial hair having a touch close to that of human hair, excellent peel resistance at room temperature, and good combing property, and a hair ornament product including the same.

According to the production method of one or more embodiments of the present invention, it is possible to obtain a core-sheath conjugate fiber for artificial hair having a touch close to that of human hair, excellent peel resistance at room temperature, and good combing property.

DETAILED DESCRIPTION OF THE EMBODIMENTS

The inventors of one or more embodiments of the present invention conducted an in-depth research in order to address the above, and found that, when a fiber for artificial hair has a flat multilobed fiber cross sectional shape, and has a core to sheath ratio by area ratio on a fiber cross section of core:sheath=2:8 to 9:1, with a viscosity ratio a/b between a melt viscosity a of a core part resin composition and a melt viscosity b of a sheath part resin composition at a nozzle set temperature during spinning in artificial fiber production being 2.0 or more and 7.0 or less, a fiber for artificial hair having a touch and appearance close to those of human hair and high peel resistance at room temperature can be obtained, and thus one or more embodiments of the present invention were achieved.

Shape of Core-Sheath Conjugate Fiber

In one or more embodiments of the present invention, the core-sheath conjugate fiber for artificial hair is comprised by a core part and a sheath part, and has a flat multilobed cross sectional shape. It is preferable that the core part also has a flat multilobed cross sectional shape. The flat multilobed shape is not particularly limited, and may be, for example, a shape in which two or more lobal portions having a shape selected from the group consisting of a circular shape and an elliptical shape are connected via recesses, and the number of lobal portions may be 2 to 10, or 2 to 8. From the viewpoint of productivity, the shape may be a flat two-lobed shape in which two circular and/or elliptical portions are connected via recesses. Furthermore, the shape of the circular or elliptical portions does not absolutely have to be a continuous arc, and may also be a substantially circular shape or a substantially elliptical shape that is partially deformed, as long as no acute angle is formed. Furthermore, no consideration needs to be given to an unevenness with a size of 2 μm or less generated at an outer circumference of a fiber cross section and an outer circumference of the core part due to an additive or the like contained.

The core-sheath conjugate fiber for artificial hair has a flat multilobed fiber cross sectional shape, and thus the fiber surface has projections and recesses and the area of flat portions decreases, and thus reflection of light is reduced. Specifically, in the case in which the core-sheath conjugate fiber for artificial hair has a flat two-lobed cross sectional shape in which two circular and/or elliptical portions are connected via recesses, four projections are formed on the two sides of the two recesses. Accordingly, reflection of light is reduced, and the fiber is likely to have a gloss similar to that of human hair.

Figure 1:
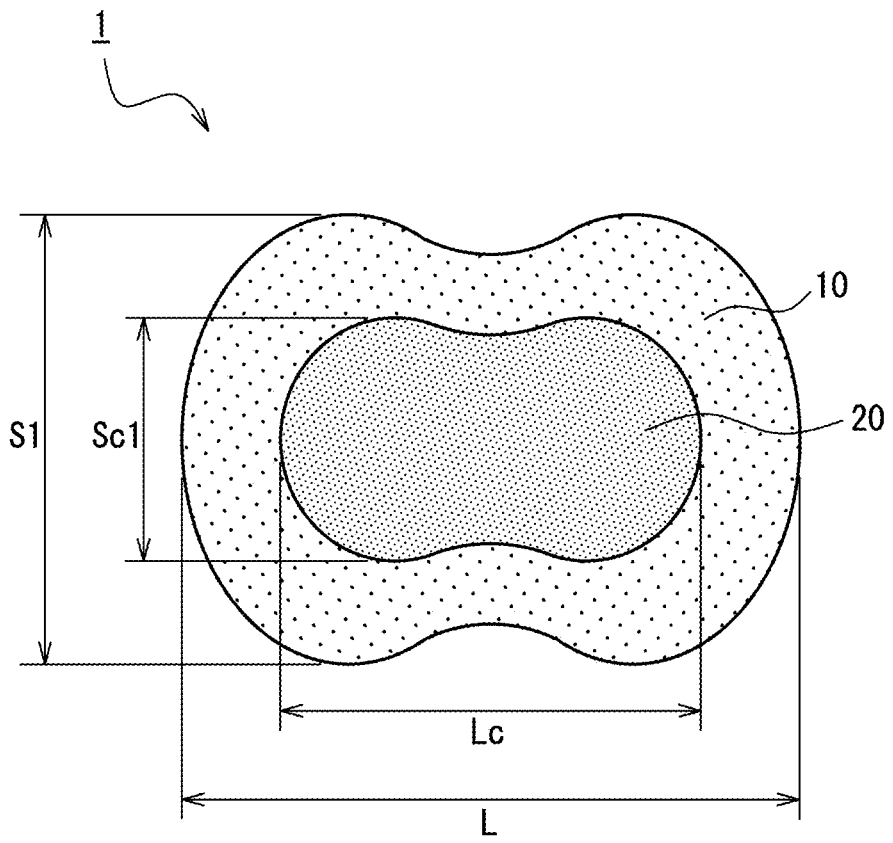
FIG. 1 is a schematic view showing a fiber cross section of a core-sheath conjugate fiber for artificial hair according to one or more embodiments of the present invention.

FIG. 1 is a schematic view showing a fiber cross section of a core-sheath conjugate fiber for artificial hair according to one or more embodiments of the present invention. A core-sheath conjugate fiber 1 for artificial hair according to this embodiment is comprised by a sheath part 10 and a core part 20, and the fiber and the core part each have a flat two-lobed cross sectional shape in which two elliptical portions are connected via recesses. Specifically, it is preferable that, in a fiber cross section, a length (represented by "L") of a major axis of the fiber cross section, which is a straight line with the largest length among an axisymmetric axis and straight lines connecting any two points on the outer circumference of the fiber cross section so as to be in parallel to the axisymmetric axis, and a length (represented by "S1") of a first minor axis of the fiber cross section, which is a straight line connecting two points so as to have the largest length when connecting any two points on the outer circumference of the fiber cross section so as to be perpendicular to the major axis of the fiber cross section, satisfy the equation (1) below.

$$L/S1 = 1.1 \text{ or more and } 2.0 \text{ or less} \quad (1)$$

Furthermore, it is preferable that, in a fiber cross section, a length (represented by "Lc") of a major axis of the core part cross section, which is a straight line with the largest length among an axisymmetric axis and straight lines connecting any two points on the outer circumference of the core part cross section so as to be in parallel to the axisymmetric axis, and a length (represented by "Sc1") of a first minor axis of the core part cross section, which is a straight line connecting two points so as to have the largest length when connecting any two points on the outer circumference of the core part cross section so as to be perpendicular to the major axis of the core part cross section, satisfy the equation (2) below.

$$Lc/Sc1 = 1.1 \text{ or more and } 2.0 \text{ or less} \quad (2)$$

The core to sheath area ratio of the core-sheath conjugate fiber for artificial hair is in the range of core:sheath=2:8 to 9:1. If the core-to-sheath area ratio is in this range, the touch, the texture, and the like are close to those of human hair, and thus artificial hair with a quality similar to that of human hair can be obtained. If the amount of core part is smaller than this range, the touch, the texture and the like thereof are poorer than that in human hair, and thus artificial hair with a quality similar to that of human hair cannot be obtained. On the other hand, if the amount of core part is larger than this range, the quality is not close to that of human hair, and, moreover, the sheath is so thin that the core is likely to be exposed, which is not preferable. From the viewpoint of obtaining the touch, the texture, and the like close to those of human hair, the core to sheath area ratio of the core-sheath conjugate fiber for artificial hair is in the range of core: sheath=3:7 to 8:2.

In the core-sheath conjugate fiber for artificial hair, the fiber cross section and the core part cross section may have the same flat multilobed shape in which the major axis direction of the fiber cross section and the major axis direction of the core part cross section substantially match each other. If the fiber cross section and the core part cross section have the same flat multilobed shape in which their major axis directions substantially match each other, in the fiber cross section, the outer circumferential shape of the fiber cross section and the outer circumferential shape of the core part are similar to each other, and thus the thickness of the sheath is uniform, and it is possible to prevent the core part from being exposed to the surface, while maintaining a good touch and appearance as artificial hair. Furthermore, since the fiber cross section and the core part cross section have a flat multilobed shape, recesses and projections are formed on the core-sheath interface, which disperses stress that is generated at the core-sheath interface due to deformation such as bending, and thus it is possible to prevent fiber separation due to coming off of the two components from each other. Furthermore, since the major axis directions of the fiber cross section and the core part cross section substantially match each other, the entire fiber and the core part have the same anisotropy of the modulus of elasticity in bending resulting from the moment of inertia of area, and thus it is easy to adjust the quality required for artificial hair, such as a touch and combing property. The above-described cross sectional shapes of the fiber and the core part can be controlled by using a nozzle (pores) with a shape close to the target cross sectional shape.

From the viewpoint of suitability for artificial hair, the core-sheath conjugate fiber for artificial hair may have a single fiber fineness of 10 dtex or more and 150 dtex or less, 30 dtex or more and 120 dtex or less, 40 dtex or more and 100 dtex or less, or 50 dtex or more and 90 dtex or less.

It is not absolutely necessary that all of the core-sheath conjugate fibers for artificial hair have the same fineness and the same cross sectional shape, and there may be fibers with different finenesses or different cross sectional shapes in a mixed manner. Furthermore, in a fiber cross section of the core-sheath conjugate fiber for artificial hair, it is preferable that the core part is completely covered by the sheath part without being exposed to the fiber surface, in order to prevent the core part and the sheath part from being peeled from each other.

Melt Viscosity

The melt viscosity of the core part resin composition or the sheath part resin composition is a value obtained through measurement using a resin composition in the form of pellets dehumidified and dried to have a water absorption content (alternatively referred to as a "moisture content") of 1000 ppm or less, under conditions of a resin composition sample amount of 20 cc, a piston speed of 200 mm/min, a capillary length of 20 mm, and a capillary diameter of 1 mm, while taking the temperature during formation of fibers, that is, the nozzle temperature during spinning as a set temperature. In the case of adding additives such as a flame retardant or a pigment, the resin and the additives are melt kneaded in advance using an ordinary kneader, and the mixture is pelletized and then used for the measurement. For example, a capillary rheometer LCR7000 manufactured by Dynisco is used as the measurement apparatus.

In the core-sheath conjugate fiber for artificial hair, a viscosity ratio a/b between a melt viscosity a of the core part resin composition and a melt viscosity b of the sheath part resin composition during spinning in artificial fiber production is 2.0 or more and 7.0 or less. If the viscosity ratio a/b is within this range, it is possible to obtain a cross sectional shape reproducing the nozzle shape, and, it may be possible to obtain a core-sheath conjugate fiber whose fiber cross section and core part cross section have the same flat multilobed cross sectional shape in which the major axis direction of the fiber cross section and the major axis direction of the core part cross section substantially match each other. In the core-sheath conjugate fiber, the cross sectional shape of the core part significantly changes according to the viscosity ratio between the core part resin composition and the sheath part resin composition during formation of fibers, wherein the smaller the viscosity ratio a/b, the larger the change in the cross sectional shape of the core part. Accordingly, if the viscosity ratio a/b is less than 2.0, it is difficult to shape the core part so as to have a cross sectional shape reproducing the nozzle shape, which lowers the peel resistance. On the other hand, if the viscosity ratio a/b is more than 7.0, the viscosity of the sheath component is so low that the flow of the resin inside a conjugate spinning nozzle is unstable, which makes it difficult to stably perform spinning.

Fiber Composition

The composition of the core-sheath conjugate fiber for artificial hair is not particularly limited, and, for example, the core-sheath conjugate fiber for artificial hair can be comprised by a resin composition such as a polyester-based resin composition, a polyamide-based resin composition, a vinyl chloride-based resin composition, a modacrylic-based resin composition, a polycarbonate-based resin composition, a polyolefin-based resin composition, or a polyphenylene-sulfide-based resin composition. Furthermore, these resin compositions may be used in a combination of two or more. Furthermore, from the viewpoint of flame retardancy, a flame retardant may be used in combination, and a polyester-based resin composition containing a polyester-based resin and a bromine-based polymer flame retardant, a polyamide-based resin composition containing a polyamide-based resin and a bromine-based polymer flame retardant, and the like may be used. From the viewpoint of heat resistance and flame retardancy, the core part and/or the sheath part of the core-sheath conjugate fiber for artificial hair may be comprised by a polyester-based resin composition containing a polyester resin and a bromine-based polymer flame retardant. Specifically, a fiber obtained by melt spinning a polyester-based resin composition containing a polyester resin and a bromine-based polymer flame retardant can be used. The core part and/or the sheath part may be comprised by a polyester-based resin composition containing 100 parts by weight of one or more types of polyester resins selected from the group consisting of polyalkylene terephthalate and a copolymerized polyester mainly containing polyalkylene terephthalate, and 5 parts by weight or more and 40 parts by weight or less of bromine-based polymer flame retardant.

The polyalkylene terephthalate is not particularly limited, and may be, for example, polyethylene terephthalate, polypropylene terephthalate, polybutylene terephthalate, or polycyclohexane dimethylene terephthalate. The copolymerized polyester mainly containing polyalkylene terephthalate is not particularly limited, and may be, for example, a copolymerized polyester mainly containing polyalkylene terephthalate such as polyethylene terephthalate, polypropylene terephthalate, polybutylene terephthalate, or polycyclohexane dimethylene terephthalate, and further containing other copolymerizable components. In the present disclosure, the "copolymerized polyester mainly containing polyalkylene terephthalate" refers to a copolymerized polyester containing polyalkylene terephthalate in an amount of 80 mol % or more.

Examples of the other copolymerizable components include: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids and their derivatives containing sulfonates such as 5-sodiumsulfoisophthalic acid and dihydroxyethyl 5-sodiumsulfoisophthalate; 1,2-propanediol; 1,3-propanediol; 1,4-butanediol; 1,6-hexanediol; neopentyl glycol; 1,4-cyclohexanedimethanol; diethylene glycol; polyethylene glycol; trimethylolpropane; pentaerythritol; 4-hydroxybenzoic acid; ε-caprolactone; and an ethylene glycol ether of bisphenol A.

The copolymerized polyester may be produced by adding a small amount of other copolymerizable components to polyalkylene terephthalate serving as a main component, and allowing them to react with each other, from the viewpoint of stability and ease of operation. Examples of the polyalkylene terephthalate include a polymer of terephthalic acid and/or its derivatives (e.g., methyl terephthalate) and alkylene glycol. The copolymerized polyester may be produced by adding a small amount of monomer or oligomer component serving as other copolymerizable components, to a mixture of terephthalic acid and/or its derivatives (e.g., methyl terephthalate) and alkylene glycol, used for polymerization of polyalkylene terephthalate serving as a main component, and subjecting them to polymerization.

It is sufficient that the copolymerized polyester has a structure in which the other copolymerizable components are polycondensed on the main chain and/or side chain of polyalkylene terephthalate serving as a main component, and the copolymerization method and the like are not particularly limited.

Specific examples of the copolymerized polyester mainly containing polyalkylene terephthalate include a polyester obtained through copolymerization of polyethylene terephthalate serving as a main component with one compound selected from the group consisting of an ethylene glycol ether of bisphenol A, 1,4-cyclohexanedimethanol, isophthalic acid, and dihydroxyethyl 5-sodiumsulfoisophthalate.

The polyalkylene terephthalate and the copolymerized polyester mainly containing polyalkylene terephthalate may be used alone or in a combination of two or more. In particular, polyethylene terephthalate; polypropylene terephthalate; polybutylene terephthalate; a polyester obtained through copolymerization of polyethylene terephthalate serving as a main component with an ethylene glycol ether of bisphenol A; a polyester obtained through copolymerization of polyethylene terephthalate serving as a main component with 1,4-cyclohexanedimethanol; a polyester obtained through copolymerization of polyethylene terephthalate serving as a main component with isophthalic acid; a polyester obtained through copolymerization of polyethylene terephthalate serving as a main component with dihydroxyethyl 5-sodiumsulfoisophthalate, and the like may be used alone or in a combination of two or more.

The intrinsic viscosity (alternatively referred to as an "IV value") of the polyester resin is not particularly limited, but it may be 0.3 or more and 1.2 or less, or 0.4 or more and 1.0 or less. If the intrinsic viscosity is 0.3 or more, the mechanical strength of the obtained fiber does not decrease, and there is no risk of dripping during a combustion test. On the other hand, if the intrinsic viscosity is 1.2 or less, the molecular weight is not too large, and the melt viscosity is not too high, and thus it is easy to perform melt spinning, and the fineness is likely to be uniform.

The bromine-based polymer flame retardant is not particularly limited, but, for example, it is preferable to use a brominated epoxy-based flame retardant from the viewpoint of heat resistance and flame retardancy. The brominated epoxy-based flame retardant may use, as a raw material, a brominated epoxy-based flame retardant having an epoxy group or tribromophenol at a molecular end thereof. The structure of the brominated epoxy-based flame retardant after melt kneading is not particularly limited, but it is preferable that 80 mol % or more of the structure is comprised by a constituent unit represented by the formula (1) below when the total number of constituent units each represented by the formula (1) below and constituent units obtained by at least partially modifying the formula (1) below is taken as 100 mol %. The structure of the brominated epoxy-based flame retardant may change at a molecular end thereof after melt kneading. For example, a molecular end of the brominated epoxy-based flame retardant may be substituted by a hydroxyl group, a phosphate group, a phosphonic acid group, or the like other than an epoxy group or tribromophenol, or may be bound to a polyester component through an ester group.

(1)

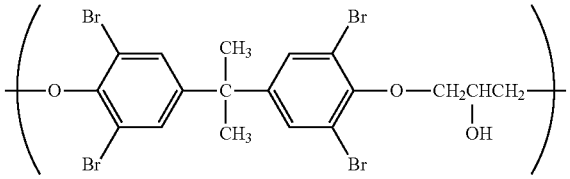

Furthermore, part of the structure of the brominated epoxy-based flame retardant, other than the molecular end, may be changed. For example, the brominated epoxy-based flame retardant may have a branched structure in which the secondary hydroxyl group and the epoxy group are bound. Also, part of the bromine of the formula (1) above may be eliminated or added, as long as the bromine content in the molecules of the brominated epoxy-based flame retardant does not change significantly.

For example, a polymeric brominated epoxy-based flame retardant as represented by the formula (2) below may be used as the brominated epoxy-based flame retardant. In the formula (2) below, m is 1 to 1000. Examples of the polymeric brominated epoxy-based flame retardant represented by the formula (2) below include a commercially available product such as a brominated epoxy-based flame retardant (product name "SR-T2MP") manufactured by Sakamoto Yakuhin Kogyo Co., Ltd.

(2)

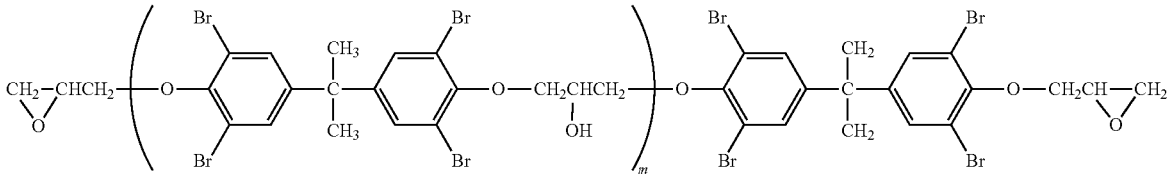

The polyamide-based resin for use in one or more embodiments of the present invention means a nylon resin obtained through polymerization of one or more selected from the group consisting of lactam, aminocarboxylic acid, a mixture of dicarboxylic acid and diamine, a mixture of a dicarboxylic acid derivative and diamine, and a salt of dicarboxylic acid and diamine.

Specific examples of the lactam include, but are not particularly limited to, for example, 2-azetidinone, 2-pyrrolidinone, δ-valerolactam, ε-caprolactam, enantholactam, capryllactam, undecalactam, and laurolactam. Of these lactams, it is preferable to use ε-caprolactam, undecalactam, and laurolactam, and more preferable to use ε-caprolactam. These lactams may be used alone or in a combination of two or more.

Specific examples of the aminocarboxylic acid include, but are not particularly limited to, for example, 6-aminocaproic acid, 7-aminoheptanoic acid, 8-aminooctanoic acid, 9-aminononanoic acid, 10-aminodecanoic acid, 11-aminoundecanoic acid, and 12-aminododecanoic acid. Of these aminocarboxylic acids, it is preferable to use 6-aminocaproic acid, 11-aminoundecanoic acid, and 12-aminododecanoic acid, and more preferable to use 6-aminocaproic acid. These aminocarboxylic acids may be used alone or in a combination of two or more.

Specific examples of the dicarboxylic acid that can be used for the mixture of dicarboxylic acid and diamine, the mixture of a dicarboxylic acid derivative and diamine, or the salt of dicarboxylic acid and diamine include, but are not particularly limited to, for example: aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cyclohexane dicarboxylic acid; and aromatic dicarboxylic acids such as phthalic acid, isophthalic acid, terephthalic acid, and naphthalenedicarboxylic acid. Of these dicarboxylic acids, it is preferable to use adipic acid, sebacic acid, dodecanedioic acid, terephthalic acid, and isophthalic acid, and more preferable to use adipic acid, terephthalic acid, and isophthalic acid. These dicarboxylic acids may be used alone or in a combination of two or more.

Specific examples of the diamine that can be used for the mixture of dicarboxylic acid and diamine, the mixture of a dicarboxylic acid derivative and diamine, or the salt of dicarboxylic acid and diamine include, but are not particularly limited to, for example: aliphatic diamines such as 1,4-diaminobutane, 1,5-diaminopentane, 1,6-diaminohexane, 2-methyl-1,5-diaminopentane (MDP), 1,7-diaminoheptane, 1,8-diaminooctane, 1,9-diaminononan, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as m-xylylenediamine and p-xylylenediamine. Of these diamines, it is preferable to use an aliphatic diamine, and more preferable to use hexamethylenediamine. These diamines may be used alone or in a combination of two or more.

The polyamide-based resin (alternatively referred to as a "nylon resin") is not particularly limited, but it is preferable to use, for example, Nylon 6, Nylon 66, Nylon 11, Nylon 12, Nylon 6/10, Nylon 6/12, semi-aromatic nylon containing the Nylon 6T and/or 61 unit, copolymers of these nylon resins, or the like. It is more preferable to use Nylon 6, Nylon 66, or a copolymer of Nylon 6 and Nylon 66.

The polyamide-based resin can be produced for example, using a polyamide-based resin polymerization method in which a polyamide-based resin raw material is heated in the presence or absence of a catalyst. During the polymerization, stirring may or may not be performed, but it is preferable to perform stirring in order to obtain a uniform product. The polymerization temperature can be set as appropriate according to the degree of polymerization, the reaction yield, and the reaction time of a target polymer, but it is preferable to set the temperature to a low temperature in consideration of the quality of a finally obtained polyamide-based resin. The reaction ratio can also be set as appropriate. The pressure is not limited, but it is preferable to reduce the pressure in the system in order to efficiently let volatile components move to the outside of the system.

The polyamide-based resin for use in one or more embodiments of the present invention may have a terminal end that is capped by an end-capping agent such as a carboxylic acid compound or an amine compound as necessary. The concentration of terminal end amino groups or terminal end carboxyl groups in a polyamide-based resin obtained when a terminal end is capped by adding monocarboxylic acid or monoamine is lower than that when such an end-capping agent is not used. On the other hand, the total concentration of terminal end amino groups and terminal end carboxyl groups does not change when a terminal end is capped by dicarboxylic acid or diamine, but the concentration ratio between terminal end amino groups and terminal end carboxyl groups changes.

Specific examples of the carboxylic acid compound include, but are not particularly limited to, for example: aliphatic monocarboxylic acids such as acetic acid, propionic acid, butyric acid, valeric acid, caproic acid, enanthic acid, caprylic acid, pelargonic acid, undecanoic acid, lauric acid, tridecanoic acid, myristic acid, myristoleic acid, palmitic acid, stearic acid, oleic acid, linoleic acid, and arachic acid; alicyclic monocarboxylic acids such as cyclohexanecarboxylic acid and methylcyclohexanecarboxylic acid; aromatic monocarboxylic acids such as benzoic acid, toluic acid, ethylbenzoic acid, and phenylacetic acid; aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cyclohexanedicarboxylic acid; and aromatic dicarboxylic acids such as phthalic acid, isophthalic acid, terephthalic acid, and naphthalenedicarboxylic acid.

Specific examples of the amine compound include, but are not particularly limited to, for example: aliphatic monoamines such as butylamine, pentylamine, hexylamine, heptylamine, octylamine, 2-ethylhexylamine, nonylamine, decylamine, undecylamine, dodecylamine, tridecylamine, tetradecylamine, pentadecylamine, hexadecylamine, octadecylamine, nonadecylamine, and icosylamine; alicyclic monoamines such as cyclohexylamine and methylcyclohexylamine; aromatic monoamines such as benzylamine and f3-phenylethylamine; aliphatic diamines such as 1,4-diaminobutane, 1,5-diaminopentane, 1,6-diaminohexane, 1,7-diaminoheptane, 1,8-diaminooctane, 1,9-diaminononan, 1,10-diaminodecane, 1,11-diaminoundecane, 1,12-diaminododecane, 1,13-diaminotridecane, 1,14-diaminotetradecane, 1,15-diamino pentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as xylylenediamine.

The terminal end group concentration of the polyamide-based resin is not particularly limited, but the terminal end amino group concentration may be high, for example, when it is necessary to increase the dyeability for fiber uses or when designing a material suitable for alloying for resin uses. On the other hand, the terminal end amino group concentration may be low, for example, when it is required to suppress coloring or gelation under extended aging conditions. Furthermore, the terminal end carboxyl group concentration and the terminal end amino group concentration may be both low when it is required to suppress reproduction of lactam during re-melting, yarn breakage during melt spinning due to production of oligomer, mold deposit during continuous injection molding, and generation of die marks during continuous extrusion of a film. It is preferable to adjust the terminal end group concentration according to the applications, but the terminal end amino group concentration and the terminal end carboxyl group concentration may be both $1.0\times10^{-5}$ to $15.0\times10^{-5}$ eq/g, $2.0\times10^{-5}$ to $12.0\times10^{-5}$ eq/g, or $3.0\times10^{-5}$ to $11.0\times10^{-5}$ eq/g.

Furthermore, the end-capping agent may be added using a method in which the end-capping agent is added simultaneously with raw materials such as caprolactam at the initial stage of polymerization, a method in which the end-capping agent is added during polymerization, a method in which the end-capping agent is added when a nylon resin in a molten state is caused to pass through a vertical stirring thin-film evaporator, or the like. The end-capping agent may be added without any treatment, or in the form of being dissolved in a small amount of solvent.

From the viewpoint of obtaining a touch and appearance closer to those of human hair and improving the curling properties and curl retention properties, the core part of the core-sheath conjugate fiber for artificial hair may be comprised by a polyester-based resin composition containing, as a main component, one or more types of polyester resins selected from the group consisting of polyalkylene terephthalate and a copolymerized polyester mainly containing polyalkylene terephthalate, and the sheath part thereof may be comprised by a polyamide-based resin composition containing, as a main component, a polyamide-based resin mainly containing at least one selected from the group consisting of Nylon 6 and Nylon 66. In the present disclosure, the "polyamide-based resin mainly containing at least one selected from the group consisting of Nylon 6 and Nylon 66" means a polyamide-based resin containing Nylon 6 and/or Nylon 66 in an amount of 80 mol % or more.

In the present disclosure, the "main component resin" means a resin with the highest content among resins contained in the resin composition.

The polyester-based resin composition constituting the core part may further contain other resins in addition to the polyester-based resin serving as a main component resin. When the total amount of resins in the polyester-based resin composition is taken as 100% by weight, the polyester-based resin serving as the main component resin may be contained in an amount of more than 50% by weight, 70% by weight or more, 85% by weight or more, 90% by weight or more, 95% by weight or more, or 100% by weight. Examples of the other resins include a polyamide-based resin, a vinyl chloride-based resin, a modacrylic-based resin, a polycarbonate-based resin, a polyolefin-based resin, and a polyphenylenesulfide-based resin. These resins may be used alone or in a combination of two or more.

The polyamide-based resin composition constituting the sheath part may further contain other resins in addition to the polyamide-based resin serving as a main component resin. When the total amount of resins in the polyamide-based resin composition is taken as 100% by weight, the polyamide-based resin serving as the main component resin may be contained in an amount of more than 50% by weight, 70% by weight or more, 85% by weight or more, 90% by weight or more, 95% by weight or more, or 100% by weight. Examples of the other resins include a polyester-based resin, a vinyl chloride-based resin, a modacrylic-based resin, a polycarbonate-based resin, a polyolefin-based resin, and a polyphenylenesulfide-based resin. These resins may be used alone or in a combination of two or more.

As necessary, the core-sheath conjugate fiber for artificial hair may contain various types of additives such as a flame retardant other than a brominated epoxy-based flame retardant, an auxiliary flame retardant, a heat-resistant agent, a stabilizer, a fluorescer, an antioxidant, an antistatic agent, and a pigment, within a range that does not inhibit the effects of one or more embodiments of the present invention.

Examples of the flame retardant other than a brominated epoxy-based flame retardant include a phosphorus-containing flame retardant and a bromine-containing flame retardant. Examples of the phosphorus-containing flame retardant include a phosphoric acid ester amide compound and an organic cyclic phosphorus-based compound. Examples of the bromine-containing flame retardant include: bromine-containing phosphoric acid esters such as pentabromotoluene, hexabromobenzene, decabromodiphenyl, decabromodiphenyl ether, bis(tribromophenoxy)ethane, tetrabromophthalic anhydride, ethylene bis(tetrabromophthalimide), ethylene bis(pentabromophenyl), octabromotrimethylphenylindan, and tris(tribromoneopentyl)phosphate; brominated polystyrenes; brominated polybenzyl acrylates; a brominated phenoxy resin; brominated polycarbonate oligomers; tetrabromobisphenol A and tetrabromobisphenol A derivatives such as tetrabromobisphenol A-bis(2,3-dibromopropyl ether), tetrabromobisphenol A-bis(allylether), and tetrabromobisphenol A-bis(hydroxyethyl ether); bromine-containing triazine compounds such as tris(tribromophenoxy)triazine; and bromine-containing isocyanuric acid compounds such as tris(2,3-dibromopropyl)isocyanurate. Of these compounds, it is preferable to use one or more selected from the group consisting of a phosphoric acid ester amide compound, an organic cyclic phosphorus-based compound, and a brominated phenoxy resin flame retardant, from the viewpoint of excellent flame retardancy.

Examples of the auxiliary flame retardant include an antimony-based compound and a composite metal including antimony. Examples of the antimony-based compound include antimony trioxide, antimony tetraoxide, antimony pentoxide, sodium antimonate, potassium antimonate, and calcium antimonate. It is more preferable to use one or more selected from the group consisting of antimony trioxide, antimony pentoxide, and sodium antimonate, from the viewpoint of improving the flame retardancy and the influence on a touch.

If the core-sheath conjugate fiber for artificial hair is comprised by a thermoplastic resin composition such as a polyester-based resin composition, it is possible to produce a core-sheath conjugate fiber for artificial hair by pelletizing the thermoplastic resin composition through melt kneading using various types of ordinary kneaders, and then performing melt spinning using a core-sheath conjugate spinneret. For example, if the core-sheath conjugate fiber for artificial hair is comprised by a polyester-based resin composition, it is possible to produce the fiber using a production method as follows. That is, it is possible to produce the fiber by melt kneading a polyester-based resin composition in which components such as a polyester resin and a brominated epoxy-based flame retardant as described above are dry blended, using various types of ordinary kneaders, pelletizing the polyester resin composition after melt kneading, and then performing melt spinning. As necessary, the polyester-based resin composition may contain other thermoplastic resins such as a polycarbonate-based resin. Meanwhile, if the core-sheath conjugate fiber for artificial hair is comprised by a polyamide-based resin composition, it is possible to produce the fiber by pelletizing the polyamide-based resin composition through melt kneading using various types of ordinary kneaders, and then performing melt spinning. Examples of the kneaders include a single-screw extruder, a twin-screw extruder, a roll, a Banbury mixer, and a kneader. Of these kneaders, it is preferable to use a twin-screw extruder from the viewpoint of adjusting the kneading degree and easily performing the operation.

Production Method

As the method for producing the fiber of one or more embodiments of the present invention, it is preferable to use a melt spinning method, and, for example, in the case of a polyester-based resin composition, melt spinning is performed while the temperatures of an extruder, a gear pump, a nozzle, and the like are set to 250° C. or more and 300° C. or less, after which the obtained spun yarns are allowed to pass through a heated tube, cooled to a temperature of not more than the glass transition point of polyester resin, and wound up at a speed of 50 m/min or more and 5000 m/min or less, and thus spun yarns (undrawn yarns) are obtained. Meanwhile, in the case of a polyamide-based resin composition, melt spinning is performed while the temperatures of an extruder, a gear pump, a nozzle, and the like are set to 260° C. or more and 320° C. or less, after which the obtained spun yarns are allowed to pass through a heated tube, cooled to a temperature of not more than the glass transition point of polyamide resin, and wound up at a speed of 50 m/min or more and 5000 m/min or less, and thus spun yarns (undrawn yarns) are obtained.

Specifically, during the melt spinning, a resin composition for constituting the core part is supplied from an extruder for core, a resin composition for constituting the sheath part is supplied from an extruder for sheath, and a molten polymer is extruded through a core-sheath conjugate spinning nozzle (pores) with a predetermined shape. It is necessary that the viscosity ratio a/b between the melt viscosity a of the core part resin composition and the melt viscosity b of the sheath part resin composition at a set temperature of the core-sheath conjugate nozzle is 2.0 or more and 7.0 or less. In this manner, it is possible to obtain a core-sheath conjugate fiber for artificial hair having a touch close to that of human hair, excellent peel resistance at room temperature, and good combing property.

Furthermore, the fineness can be controlled by performing a step of causing the spun yarns to pass through a water bath containing water or a solvent. The temperature and length of the heated tube, the temperature and amount of the cooling air applied, the temperature of the cooling water bath, the cooling time, and the winding speed can be adjusted appropriately in accordance with the extrusion rate of the polymer and the number of holes of the nozzle.

It is preferable that the spun yarns (undrawn yarns) are hot drawn. The drawing may be performed by either a two-step method or a direct drawing method. In the two-step method, the spun yarns are wound once, and then drawn. In the direct drawing method, the spun yarns are drawn continuously without winding. The hot drawing may be performed by a single-stage drawing method or a multi-stage drawing method that includes two or more stages.

The heating means for the hot drawing may be a heating roller, a heat plate, a steam jet apparatus, or a hot water bath, which can be used in combination as desired.

It is also possible to make the touch and texture closer to those of human hair, by adding an oil such as a fiber treatment agent and a softener to the core-sheath conjugate fiber for artificial hair. Examples of the fiber treatment agent include a silicone-based fiber treatment agent and a non-silicone-based fiber treatment agent for improving the touch and the combing property.

The core-sheath conjugate fiber for artificial hair may be subjected to treatment through gear crimping. Accordingly, it is possible to make a fiber gently curved and have a natural appearance, and to reduce the contact between fibers, thereby improving the combing property. In this treatment through gear crimping, typically, a fiber heated to the softening temperature or more is caused to pass through a portion between two meshing gears, so that the shape of the gears is transferred to the fiber and the fiber is thus curved. Furthermore, as necessary, it is also possible to make a fiber curled in different shapes by heat treating the core-sheath conjugate fiber for artificial hair at different temperatures during the fiber treatment processes.

Hair Ornament Product

The core-sheath conjugate fiber for artificial hair can be used for hair ornament products without particular limitation. For example, it is possible to use the core-sheath conjugate fiber for hair wigs, hairpieces, weaving hair, hair extensions, braided hair, hair accessories, doll hair, and the like.

The hair ornament product may be constituted only by the core-sheath conjugate fiber for artificial hair of one or more embodiments of the present invention. Alternatively, the hair ornament product may be comprised by the core-sheath conjugate fiber for artificial hair of one or more embodiments of the present invention combined with other fibers for artificial hair and natural fibers such as human hair and animal hair.

EXAMPLES

Hereinafter, one or more embodiments of the present invention will be more specifically described by way of examples. Note that one or more embodiments of the present invention are not limited to these examples.

The measuring methods and the evaluation methods used in the examples and comparative examples are as follows.

Melt Viscosity

The melt viscosity of a resin in the form of pellets dried to a moisture content of 1000 ppm or less used for the core part and the sheath part was measured, under conditions of a sample amount of 20 cc, a piston speed of 200 mm/min, a capillary length of 20 mm, and a capillary diameter of 1 mm, while taking the temperature during formation of fibers, that is, the nozzle temperature during spinning as a set temperature.

Single Fiber Fineness

The measurement was performed using an autovibro type fineness measuring apparatus "Denier Computer type DC-11" (manufactured by Search), and an average of measured values of 30 samples was calculated and taken as the single fiber fineness.

Peeling at Core-Sheath Interface

Fibers were bundled at room temperature (23° C.) and fixed with a shrinkage tube such that the fiber bundle was not displaced, after which the bundle was cut using a cutter, and whether or not the core and the sheath were peeled from each other at that time was visually evaluated, or evaluated through observation of the cut fiber cross section using a laser microscope ("VK-9500" manufactured by Keyence Corporation).

Shape of Fiber Cross Section

Fibers were bundled at room temperature (23° C.) and fixed with a shrinkage tube such that the fiber bundle was not displaced, after which the bundle was cut in round slices using a cutter, and thus a fiber bundle for cross section observation was prepared. An image of this fiber bundle was captured using a laser microscope ("VK-9500" manufactured by Keyence Corporation) at a magnification of 500 times, and thus a photograph of a fiber cross section was obtained. Then, L/S1 and Lc/SC1 were obtained based on the photograph of the fiber cross section.

Touch

Sensory evaluation by professional hairstylists was performed in four stages below.

A: Very good touch similar to that of human hair

B: Good touch although it is slightly poor compared with that of human hair

C: Bad touch that is poor compared with that of human hair

D: Bad touch that is significantly poor compared with that of human hair

Combing Property

Fibers whose curls were completely stretched were cut to have a length of 63.5 cm, and 5.0 g of thus obtained fibers with a fiber length of 63.5 cm was bundled. Subsequently, the fiber bundle was bound with a string at the middle thereof, folded in half, and fixed at the string portion, and thus a fiber bundle for hair straightener treatment was prepared. Next, the fiber bundle was heated and crimped five times from the root at which the fiber bundle was fixed to the ends, using a hair straightener ("Izunami ITC450 flat iron"

manufactured by Izunami. Inc, U.S.) heated to 180° C., and thus a fiber bundle for combing property evaluation was prepared. Subsequently, a comb for combing hair ("Matador Professional 386.8 1/2F" made in Germany) was passed through the fiber bundle for combing property evaluation 100 times from the root at which the fiber bundle was fixed to the ends, and evaluated according to the following criteria based on the number of fibers deformed or split.

A: Number of fibers deformed or split after a comb is passed through the fibers 100 times is less than 10, and the comb can be passed through the fibers to the ends without resistance.

B: Number of fibers deformed or split after a comb is passed through the fibers 100 times is 10 or more and less than 30, and the comb can be passed through the fibers although the resistance somewhat significantly increases during the passing process.

C: Number of fibers deformed or split after a comb is passed through the fibers 100 times is 30 or more and less than 100, and the comb cannot be passed through the fibers once or more and less than 20 times due to the resistance having increased during the passing process.

D: Number of fibers deformed or split after a comb is passed through the fibers 100 times is 100 or more, and the comb cannot be passed through the fibers 20 times or more due to the resistance having increased during the passing process.

Example 1

Polyethylene terephthalate pellets (product name "A-12" manufactured by Eastman Chemical) and Nylon 6 pellets (product name "A1030BRL" manufactured by Unitika Ltd.) dried to a moisture content of 1000 ppm or less were supplied to a melt spinning machine, a molten polymer was extruded from a core-sheath conjugate spinning nozzle (pores) at a set temperature of 270° C. having the nozzle shape shown in Table 1, cooled to a temperature of not more than the glass transition point, and wound up at a speed of 60 to 150 m/min, and thus undrawn yarns of core-sheath conjugate fibers each having a core part comprised by polyethylene terephthalate (alternatively referred to as "PET") and a sheath part comprised by Nylon 6 (alternatively referred to as "PA6") and having a core-to-sheath area ratio of 5:5 were obtained. The obtained undrawn yarns were drawn to 3 times at 80° C., heat treated using a heat roll heated to 200° C. After application of a finishing oil A (product name "KWC-Q" manufactured by Marubishi Oil Chemical Corporation) in an amount of 0.20 omf (by oil pure weight percentage with respect to the dry fiber weight) and a finishing oil B (product name "KWC-B" manufactured by Marubishi Oil Chemical Corporation) in an amount of 0.10% omf, the yarns were dried, and thus a conjugate fiber (multifilament) having the single fiber fineness shown in Table 1 was obtained.

Example 2

A conjugate fiber was obtained in a similar way to that of Example 1, except that the resin used for the core part was changed to polyethylene terephthalate pellets (product name "DFG1" manufactured by Bell Polyester Products, Inc.) dried to a moisture content of 1000 ppm or less.

Example 3

A conjugate fiber was obtained in a similar way to that of Example 1, except that the core-to-sheath area ratio was changed to 2:8.

Example 4

A conjugate fiber was obtained in a similar way to that of Example 1, except that the core-to-sheath area ratio was changed to 8:2.

Example 5

A conjugate fiber was obtained in a similar way to that of Example 1, except that the resin used for the sheath part was changed to Nylon 66 (alternatively referred to as "PA66") (product name "Amilan CM3001" manufactured by Toray Industries, Inc.) dried to a moisture content of 1000 ppm or less, and the nozzle set temperature was changed to 280° C.

Example 6

A conjugate fiber was obtained in a similar way to that of Example 1, except that the resin used for the core part was changed to polybutylene terephthalate pellets (product name "Novaduran 5020" manufactured by Mitsubishi Chemical Corporation) dried to a moisture content of 1000 ppm or less, the nozzle set temperature was changed to 260° C., and the core-to-sheath area ratio was changed to 7:3.

Comparative Example 1

A conjugate fiber was obtained in a similar way to that of Example 1, except that a core-sheath conjugate spinning nozzle having the nozzle shape shown in Table 1 was used.

Comparative Example 2

A conjugate fiber was obtained in a similar way to that of Example 1, except that the resin used for the sheath part was changed to Nylon 6 (product name "A1030BRT" manufactured by Unitika Ltd.) dried to a moisture content of 1000 ppm or less.

Comparative Example 3

A conjugate fiber was obtained in a similar way to that of Example 1, except that the core-to-sheath area ratio was changed to 1:9.

Comparative Example 4

A conjugate fiber was obtained in a similar way to that of Example 1, except that the core-to-sheath area ratio was changed to 9.5:0.5.

Whether or not peeling occurred at a core-sheath interface and the cross sectional shape of each of the fibers of the examples and comparative examples were evaluated and observed as described above. Furthermore, the touch and the combing property of each of the fibers of the examples and comparative examples were evaluated as described above. Table 1 shows the results.

TABLE 1

| | Ex. 1 | Ex. 2 | Ex. 3 | Ex. 4 | Ex. 5 | Ex. 6 | Com. Ex. 1 | Com. Ex. 2 | Com. Ex. 3 | Com. Ex. 4 |
|---|---|---|---|---|---|---|---|---|---|---|
| Nozzle shape (core) | Flat two-lobed | Flat two-lobed | Flat two-lobed | Flat two-lobed | Flat two-lobed | Flat two-lobed | Circular | Flat two-lobed | Flat two-lobed | Flat two-lobed |
| Nozzle shape (fiber) | Flat two-lobed | Flat two-lobed | Flat two-lobed | Flat two-lobed | Flat two-lobed | Flat two-lobed | Circular | Flat two-lobed | Flat two-lobed | Flat two-lobed |
| Main component resin (core) | PET | PET | PET | PET | PET | PBT | PET | PET | PET | PET |
| Main component resin (sheath) | PA6 | PA6 | PA6 | PA6 | PA66 | PA6 | PA6 | PA6 | PA6 | PA6 |
| Core to sheath area ratio | 5:5 | 5:5 | 2:8 | 8:2 | 5:5 | 7:3 | 5:5 | 5:5 | 1:9 | 9.5:0.5 |
| Nozzle set temperature (° C.) | 270 | 270 | 270 | 270 | 280 | 260 | 270 | 270 | 270 | 270 |
| Melt viscosity a of core part resin composition (Pa · s) | 185 | 530 | 185 | 185 | 165 | 197 | 185 | 185 | 185 | 185 |
| Melt viscosity b of sheath part resin composition (Pa · s) | 81 | 81 | 81 | 81 | 72 | 89 | 81 | 158 | 81 | 81 |
| Viscosity ratio a/b | 2.3 | 6.5 | 2.3 | 2.3 | 2.3 | 2.2 | 2.3 | 1.2 | 2.3 | 2.3 |
| Single fiber fineness (dtex) | 58 | 58 | 54 | 63 | 58 | 62 | 58 | 58 | 52 | 66 |
| Cross sectional shape of core part | Flat two-lobed | Flat two-lobed | Flat two-lobed | Flat two-lobed | Flat two-lobed | Flat two-lobed | Circular | Elliptical | Flat two-lobed | Flat two-lobed |
| Cross sectional shape of fiber | Flat two-lobed | Flat two-lobed | Flat two-lobed | Flat two-lobed | Flat two-lobed | Flat two-lobed | Circular | Flat two-lobed | Flat two-lobed | — |
| Photograph of cross section | FIG. 2 | — | — | — | — | — | FIG. 3 | FIG. 4 | — | — |
| L/S1 | 1.4 | 1.4 | 1.3 | 1.4 | 1.4 | 1.3 | 1.0 | 1.5 | 1.2 | 1.4 |
| Lc/Sc1 | 1.8 | 1.8 | 1.8 | 1.7 | 1.8 | 1.7 | 1.0 | 1.5 | 1.7 | 1.6 |
| Peeling at core-sheath interface | Not peeled | Not peeled | Not peeled | Not peeled | Not peeled | Not peeled | Peeled | Peeled | Not peeled | Peeled |
| Touch | A | A | B | B | A | A | C | B | C | D |
| Combing property | B | B | A | B | B | B | D | B | A | D |

Figure 2:
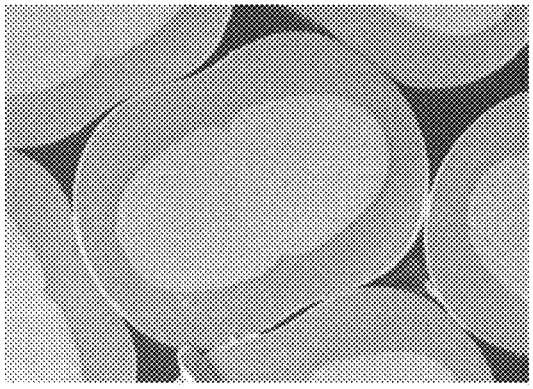
FIG. 2 is a laser microscopic photograph of a fiber cross section of a fiber of Example 1.
Figure 3:
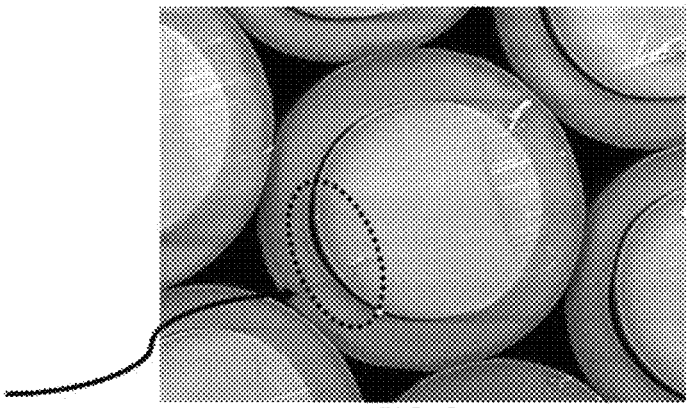
FIG. 3 is a laser microscopic photograph of a fiber cross section of a fiber of Comparative Example 1.
Figure 4:
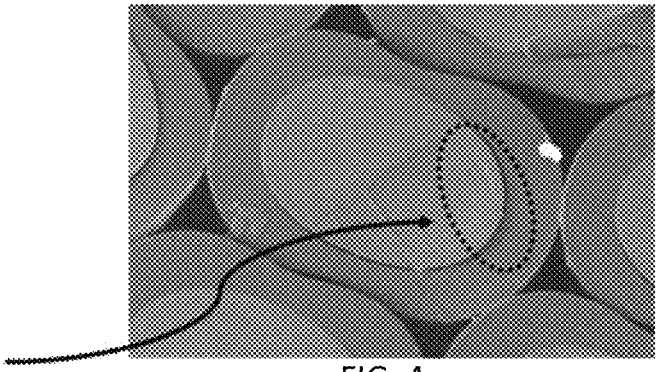
FIG. 4 is a laser microscopic photograph of a fiber cross section of a fiber of Comparative Example 2.

FIG. 2 is a laser microscopic photograph of a fiber cross section of the fiber of Example 1. FIGS. 3 and 4 are respectively laser microscopic photographs of fiber cross sections of the fibers of Comparative Examples 1 and 2. In FIGS. 3 and 4, portions indicated by the arrows are portions at which core-sheath peeling occurred.

As can be seen from Table 1 and FIG. 2, the fibers of Examples 1 to 6 had no peeling at a core-sheath interface, and had a touch close to that of human hair and good combing property. On the other hand, as can be seen from Table 1 and FIG. 3, the fiber of Comparative Example 1 having a circular cross section had peeling at a core-sheath interface. As can be seen from Table 1 and FIG. 4, in the case of Comparative Example 2 with a low viscosity ratio a/b, the shape of the core part was different from that of the nozzle, and peeling occurred at a core-sheath interface. The fiber of Comparative Example 3 lacks firmness due to its too low core component proportion, and did not have a touch similar to that of human hair. The fiber of Comparative Example 4 had a core part exposed to the fiber surface due to its too low sheath component proportion, had very poor combing property, and could not be shaped as a good fiber.

LIST OF REFERENCE NUMERALS

1 Core-sheath conjugate fiber for artificial hair (cross section)

10 Sheath part

20 Core part

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

The invention claimed is:

1. A core-sheath conjugate fiber for artificial hair comprising a core part and a sheath part, wherein the core-sheath conjugate fiber for artificial hair has a flat multilobed cross sectional shape, and has a core-to-sheath area ratio on a fiber cross section in a range of 2:8 to 9:1, a viscosity ratio a/b between a melt viscosity a of a core part resin composition and a melt viscosity b of a sheath part resin composition is 2.0 or more and 7.0 or less, the core part of the core-sheath conjugate fiber for artificial hair has the flat multilobed cross sectional shape, and a major axis direction of the fiber cross section and a major axis direction of the core part cross section match each other, the flat multilobed cross sectional shape is a flat two-lobed shape in which two circular and/or elliptical portions are connected via recesses, a length Lc of a major axis of the core part cross section and a length Sc1 of a first minor axis of the core part cross section satisfy equation (2) below, and the major axis of the core part cross section is a straight line with a largest length among an axisymmetric axis and straight lines connecting any two points on an outer circumference of the core part cross section so as to be in parallel to the axisymmetric axis, and the first minor axis of the core part cross section is a straight line connecting two points so as to have the largest length when connecting any two points on the outer circumference of the core part cross section so as to be perpendicular to the major axis of the core part cross section, $$Lc/Sc1=1.1 \text{ or more and } 2.0 \text{ or less} \quad (2).$$

2. The core-sheath conjugate fiber for artificial hair according to claim 1, wherein the core part of the core-sheath conjugate fiber for artificial hair comprises, as a main component, one or more of polyester-based resins selected from the group consisting of polyalkylene terephthalate and a copolymerized polyester mainly containing polyalkylene terephthalate.

3. The core-sheath conjugate fiber for artificial hair according to claim 1, wherein the sheath part of the core-sheath conjugate fiber for artificial hair comprises, as a main component, a polyamide-based resin mainly containing at least one selected from the group consisting of Nylon 6 and Nylon 66.

4. The core-sheath conjugate fiber for artificial hair according to claim 1, wherein a length L of a major axis of the fiber cross section and a length S1 of a first minor axis of the fiber cross section satisfy the equation (1) below, and wherein the major axis of the fiber cross section is a straight line with a largest length among an axisymmetric axis and straight lines connecting any two points on an outer circumference of the fiber cross section so as to be in parallel to the axisymmetric axis, and the first minor axis of the fiber cross section is a straight line connecting two points so as to have the largest length when connecting any two points on the outer circumference of the fiber cross section so as to be perpendicular to the major axis of the fiber cross section, $$L/S1=1.1 \text{ or more and } 2.0 \text{ or less} \quad (1).$$

5. A hair ornament product comprising the core-sheath conjugate fiber for artificial hair according to claim 1.

6. The hair ornament product according to claim 5, wherein the hair ornament product is one selected from the group consisting of a hair wig, a hairpiece, weaving hair, a hair extension, braided hair, a hair accessory, and doll hair.

* * * * *